US005787727A

United States Patent [19]

Inoue et al.

[11] Patent Number: 5,787,727

[45] Date of Patent: Aug. 4, 1998

[54] HIGH-TEMPERTURE GENERATOR

[75] Inventors: Naoyuki Inoue; Teiichi Mochizuki, both of Fujisawa; Motonao Kera, Tokyo, all of Japan

[73] Assignee: Ebara Corporation, Tokyo, Japan

[21] Appl. No.: 730,883

[22] Filed: Oct. 17, 1996

[30] Foreign Application Priority Data

Oct. 19, 1995 [JP] Japan ..... 7-296180

[51] Int. Cl.[6] ..... F25B 35/00; F25B 37/00

[52] U.S. Cl. ..... 62/496; 62/497

[58] Field of Search ..... 62/496, 497

[56] References Cited

U.S. PATENT DOCUMENTS 4,570,456 2/1986 Reimann et al. ..... 62/497 X

FOREIGN PATENT DOCUMENTS 58-51578 11/1983 Japan .

63-169455 7/1988 Japan .

3-122467 5/1991 Japan ..... 62/497

3-225164 10/1991 Japan ..... 62/496

*Primary Examiner*—Christopher Kilner

*Attorney, Agent, or Firm*—Armstrong, Westerman, Hattori, McLeland & Naughton

[57] ABSTRACT

A high-temperature generator having a high durability and reliability is disclosed. The generator comprises a double shell type furnace body defining a combustion chamber and a liquid chamber surrounding the combustion chamber. A burner is arranged at a front end of the combustion chamber for generating high temperature gas within the combustion chamber. A smoke tube assembly including a plurality of smoke tubes is arranged in the liquid chamber aligned along a longitudinal direction of the furnace body. The rear end of the smoke tube opens to the combustion chamber. A rear wall having a double-wall configuration is provided with an aperture arranged to face the rear end of the smoke tube assembly, and the aperture is covered with a cover plate detachably mounted to the rear wall.

4 Claims, 2 Drawing Sheets

HIGH-TEMPERTURE GENERATOR

BACKGROUND OF THE INVENTION

1. Field of the Invention

The present invention relates in general to a high-temperature generator for use, for example, in an absorption refrigerating machine.

2. Description of the Related Art

FIG. 3 shows a conventional high-temperature generator having a flue and smoke tubes for use in an absorption refrigerating machine, where numeral 1 depicts a flue defining a combustion chamber of a cylindrical shape therein, and numeral 3 depicts a pipe shell constructing a casing surrounding the flue 1 and smoke tubes 8. These flue 1 and pipe shell 3 construct a double-shell-type furnace body 6 comprising a liquid chamber 5 therein. A front portion of the furnace body 6 is covered with a front wall 4 which also comprise a jacket communicating with the liquid chamber 5. The rear portion of the furnace body 6 is provided with a rear wall member 7 separately formed with a refractory material into a pan-like shape.

As shown in FIG. 2, the flue 1 is formed to have a substantially circular cross section, the pipe shell 3 is formed to have an ellipse cross section elongated in a vertical direction, and the flue 1 is arranged offset in a downward direction relative to the center of the pipe shell 3. A plurality of smoke tubes 8 are provided within a liquid chamber 5 on the upper side of the ceiling portion of the combustion chamber 2, which are arranged parallel to the longitudinal axis of the flue 1. One end of each smoke tube 8 opens to a rear smoke chamber 9 which is located in the rear portion of the combustion chamber 2, and the other end opens to a front smoke chamber 10 which is located outside of the front wall 4. A burner 11 for forming a combustion flame within the combustion chamber 2 is provided on the front wall 4. Numeral 12 depicts a funnel provided to the front smoke chamber 10.

Liquid chamber 5 formed in the lateral and lower walls of the pipe shell 3 or the front wall 4 is filled with liquid L and the upper area of the liquid surface Ls is filled with vapor V vaporized through heat exchange with the combustion gas. The liquid chamber 5 is connected, for example, with an absorption refrigerating machine by way of a vapor discharge pipe 13*a* and a liquid inlet pipe 13*b* for circulating absorption agent therebetween. It is necessary to form the rear wall member 7 separately from the furnace body 6 with a refractory material so as to be detachable for inspection and cleaning of the smoke tubes 8.

However, in the conventional high-temperature generator described above, since the rear wall member 7 having a relatively large dimension and a complicated shape is formed with a material of low formability and/or low strength, it has problems of low durability, low reliability and/or high manufacturing or maintenance cost.

SUMMARY OF THE INVENTION

It is an object of the present invention to provide a high-temperature generator having a high durability and reliability by minimizing the dimension of the refractory assembly portion at the rear smoke chamber.

The above object has been achieved in a high-temperature generator comprising: a double shell type furnace body defining a combustion chamber and a liquid chamber surrounding the combustion chamber; a burner arranged at a front end of the combustion chamber for generating high temperature gas within the combustion chamber thereby conducting heat exchange between the high temperature gas and liquid within the liquid chamber; and a smoke tube assembly including a plurality of smoke tubes arranged in the liquid chamber along a longitudinal direction of the furnace body, the rear end of the smoke tube being open to the combustion chamber; wherein a rear wall having a double-wall configuration is provided with an aperture arranged to face the rear end of the smoke tube assembly, and the aperture is covered with a cover plate detachably mounted to the rear wall.

According to the high-temperature generator, the aperture can be formed in an appropriate size capable of conducting cleaning of the smoke tubes. Therefore, the cover plate can be formed to have a small size and a simple construction, thus making the durability of this portion higher and the manufacturing cost lower.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
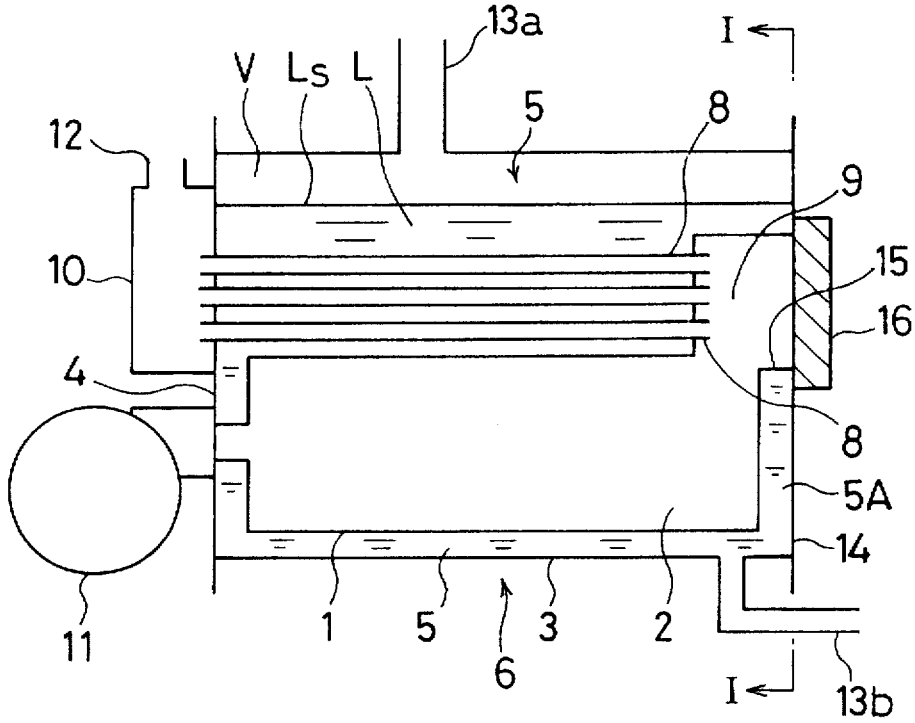
FIG. 1 is a cross sectional view of an embodiment of the high-temperature generator according to the present invention.
Figure 2:
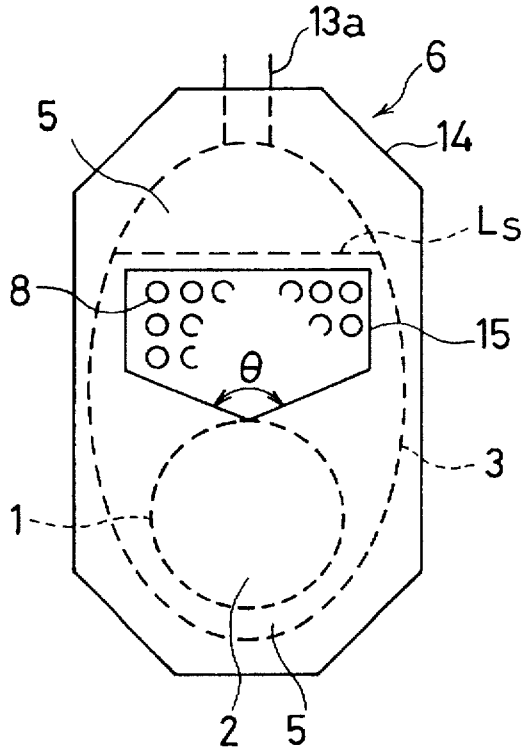
FIG. 2 is a cross sectional view along the line I—I in FIG. 1.
Figure 3:
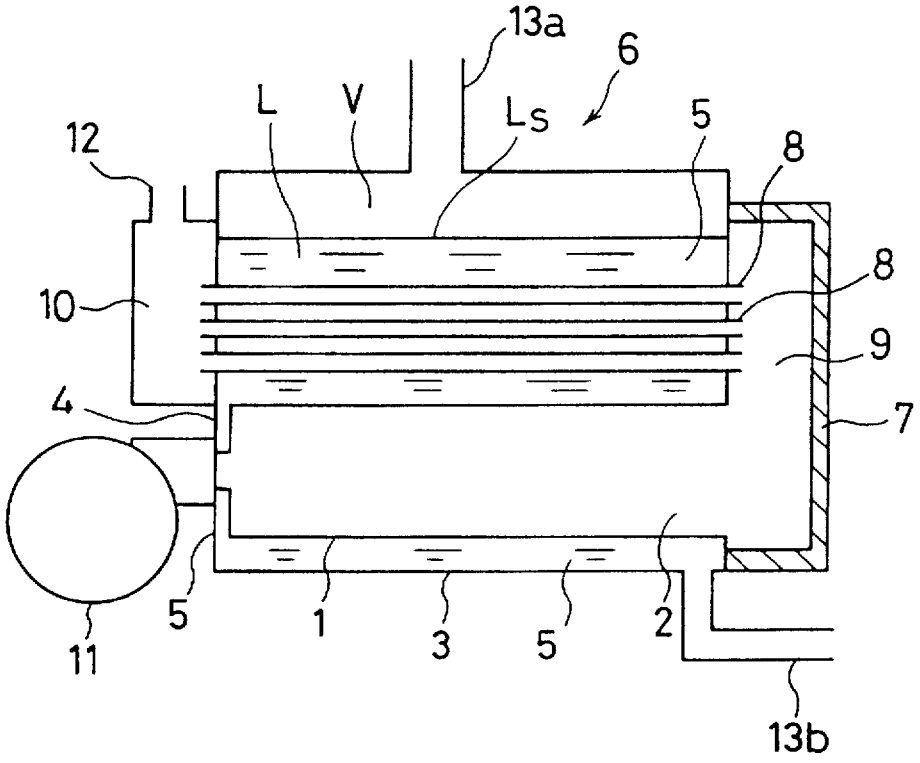
FIG. 3 is a cross sectional view of conventional high-temperature generator.

FIG. 1 and FIG. 2, which is a cross sectional view along the line I—I in FIG. 1, show an embodiment of the present invention. In the following description, the same numeral is used for the corresponding element with the conventional apparatus shown in FIG. 3.

In this embodiment, the furnace body 6 has the same configuration at its front side, but the rear side portion surrounding the rear smoke chamber 9 has been changed. That is, a rear wall 14 is provided so as to be integrally formed with the furnace body 6. The rear wall 14 has also a double-wall structure like the other portion of the furnace body 6, in which a rear liquid chamber 5A communicating with the liquid chamber 5 is formed. An aperture 15 is formed on the rear wall 14 at a location corresponding to the smoke tubes 8, that is, in a way to face the opening end of the smoke tubes 8. A covering plate 16 made of a suitable material is detachably attached to cover the aperture 15 with a suitable fastening means.

In this embodiment, the aperture 15 is formed in a pentagonal shape with a relatively large width in a horizontal direction so as to correspond to the arrangement the smoke tubes 8. One of the corners of the aperture 15 resides in a downward direction, that is, the aperture 15 is formed to have a convex portion in a downward direction. This downward corner has an angle θ which is determined so that, in the liquid chamber 5A just below the aperture 15, sequestration of the liquid flow is prevented when the liquid L flows upwards through convection. The cover plate 16 is formed with a refractory material in a size a little larger than the aperture 15.

In the high-temperature generator described above, combustion gas generated by the burner 11 first heats the liquid L within the liquid chambers 5 and 5A mainly through radiation, then enters into the smoke tubes 8 by way of the rear smoke chamber 9 and heats the liquid L within the upper liquid chamber 5. Inside the liquid chambers 5 and 5A, heat transfer is conducted through convection, and the heated liquid gradually flows upwards and then is vaporized and sent to the absorption refrigerating machine etc. by way of the discharge pipe 13*a*.

The combustion gas temperature is as high as approximately 1,500° C. within the combustion chamber 2, approximately 900° C. within the rear smoke chamber 9, and approximately 250° C. within the front smoke chamber 10 at the exit of the smoke tubes 8. The combustion gas is discharged from the front smoke chamber 10 to the exterior of the apparatus by way of funnel 12.

In order to conduct inspection or cleaning of the smoke tubes 8, the cover plate 16 is detached from the rear wall 14 by releasing the fastening means. In the above described high-temperature generator, since the aperture 15 is formed in an appropriate size capable of conducting cleaning of the smoke tubes 8, the cover plate 16 can be formed to have a small size and a simple construction compared to the rear wall member 7 of the conventional apparatus shown in FIG. 3. Therefore, the durability of this portion is higher and the manufacturing cost is lower. Further, since the aperture 15 is formed to have a convex portion protruding in a downward direction with a corner of angle θ, a smooth upward liquid flow within the liquid chamber 5A just below the aperture 15 is retained. Therefore, deformation of the elements constructing the rear wall 14 resulting from local overheating and disturbance of the heat exchange as well as occurrence of corrosion accidents is prevented so as to retain a smooth operation.

Although certain preferred embodiment of the present invention has been shown and described in detail, it should be understood that various changes and modifications may be made therein without departing from the scope of the appended claims.

What is claimed is:

1. A high-temperature generator comprising:

a double shell type furnace body defining a combustion chamber and a liquid chamber surrounding said combustion chamber;

a burner arranged at a front end of said combustion chamber for generating high temperature gas within said combustion chamber thereby conducting heat exchange between said high temperature gas and liquid within said liquid chamber;

a smoke tube assembly including a plurality of smoke tubes arranged in said liquid chamber along a longitudinal direction of said furnace body, the rear end of said smoke tube being open to said combustion chamber, wherein a rear wall having a double-wall configuration is provided with an aperture arranged to face said rear end of said smoke tube assembly, and said aperture is covered with a cover plate detachably mounted to said rear wall, and wherein said aperture is formed to have a convex portion protruding in a downward direction.

2. A high-temperature generator as claimed in claim 1, wherein said convex is formed to have a corner.

3. A high-temperature generator as claimed in claim 1, wherein said cover plate is formed with a refractory material.

4. A high-temperature generator as claimed in claim 1, wherein said liquid is an absorption agent for absorption refrigerating machine.

* * * * *